US006687924B2

(12) United States Patent
Wright et al.

(10) Patent No.: US 6,687,924 B2
(45) Date of Patent: Feb. 10, 2004

(54) SOAP DISPENSING SHOWER HEAD AND BRUSH HEAD

(76) Inventors: David Wright, 1548 Center Rd. #21, Novato, CA (US) 94947; Kenneth Tarlow, 21 Golden Hind Passage, Corte Madera, CA (US) 94925

( * ) Notice: Subject to any disclaimer, the term of this patent is extended or adjusted under 35 U.S.C. 154(b) by 0 days.

(21) Appl. No.: 10/303,149

(22) Filed: Nov. 25, 2002

(65) Prior Publication Data

US 2003/0126678 A1 Jul. 10, 2003

(51) Int. Cl.[7] ..... A47K 7/02
(52) U.S. Cl. ..... 4/606
(58) Field of Search ..... 4/606; 15/22.1, 15/104.92

(56) References Cited

U.S. PATENT DOCUMENTS 3,875,604 A * 4/1975 Wurn et al. ..... 15/21.1
4,151,623 A * 5/1979 Steere ..... 15/21.1
4,155,137 A * 5/1979 Kadlub ..... 15/4
5,561,869 A * 10/1996 Sarel ..... 4/606
5,588,160 A * 12/1996 Nichols ..... 4/606
5,774,907 A * 7/1998 Doggwiler ..... 4/606
6,151,728 A * 11/2000 Wright et al. ..... 4/606

* cited by examiner

*Primary Examiner*—Charles E. Phillips
(74) *Attorney, Agent, or Firm*—Michael Shippey

(57) ABSTRACT

Soap dispensing shower head and brush head with a flexible hose and attachment to fasten to a standard water supply and shower spigot. An enclosed chamber contains a water driven paddle wheel. The paddle wheel drives a first set of gears that cause a scrub brush to rotate. A second set of gears powered by the paddle wheel that cause a cam to rotate. The cam pushes against a soap delivery pump head causing the soap to be pushed through an aperture that runs through the center of the shower head assembly. A selector valve allows the user to choose between the shower function and the rotating brush, soap delivery function, an additional mechanical selector switch that allows the user to turn the soap delivery function on or off. A soap containing reservoir is connected to the enclosure and also acts as a handle portion.

2 Claims, 4 Drawing Sheets

SOAP DISPENSING SHOWER HEAD AND BRUSH HEAD

CROSS REFERENCE TO RELATED APPLICATIONS

My previous U.S. Pat. No. 6,151,728 is directed to similar subject matter as disclosed herein.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of shower heads and more specifically to a soap dispensing shower head and brush head. Within the past one hundred years, taking a shower in an enclosure shower stall has become a popular and accepted means of cleaning ones self. In a shower enclosure a person may turn on the flow of hot or cold water so that it comes out under pressure from a shower head usually located above the user. The user then applies soap to his or her body and proceeds to gently scrub the body either by hand or with the assistance of a wash cloth, cleaning brush or the like. While the standard method of washing as just described is efficacious, it tends to be time consuming and cumbersome. Standard scrub brushes tend to have stationary bristles or the like and require the user to move his or her arm and hand in an awkward manner to provide adequate cleaning. Furthermore, it is a problem when using a bar of soap or even a liquid soap, having the soap prematurely diluted by the oncoming shower water. The use of a separate shower head, scrub brush and soap require more time and e to use and are less efficient than the combination shower head, rotating scrub brush and automatic soap delivery system of the present invention described below.

BRIEF SUMMARY OF THE INVENTION

The primary object of the invention is to provide an improved shower head that includes a shower function, a rotary scrub brush function and a soap delivery function that is activated by water power.

Another object of the invention is to provide a shower head that includes a selector valve that allows the head to function as a shower head or a soap delivery duct.

A further object of the invention is to provide an additional selector switch that allows the user to use the rotating brush portion with or without dispensing soap.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Soap Dispensing Shower Head and Brush Head comprising: a flexible hose and attachment means to fasten to a standard water supply and shower spigot, a hanging bracket secured to said shower spigot that releasably secures said shower head, an enclosed chamber that contains a paddle wheel, said paddle wheel driving a first set of gears that cause a scrub brush to rotate, a second set of gears powered by said paddle wheel that cause a cam to rotate, said cam pushing against a soap delivery pump causing said soap to be pushed through an aperture that runs through the center of said shower head assembly, a selector valve that allows the user to choose between the shower function and the rotating brush, soap delivery function, an additional mechanical selector switch that allows the user to turn the soap delivery function on or off, and a soap containing reservoir connected to said enclosure that also acts as a handle portion.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
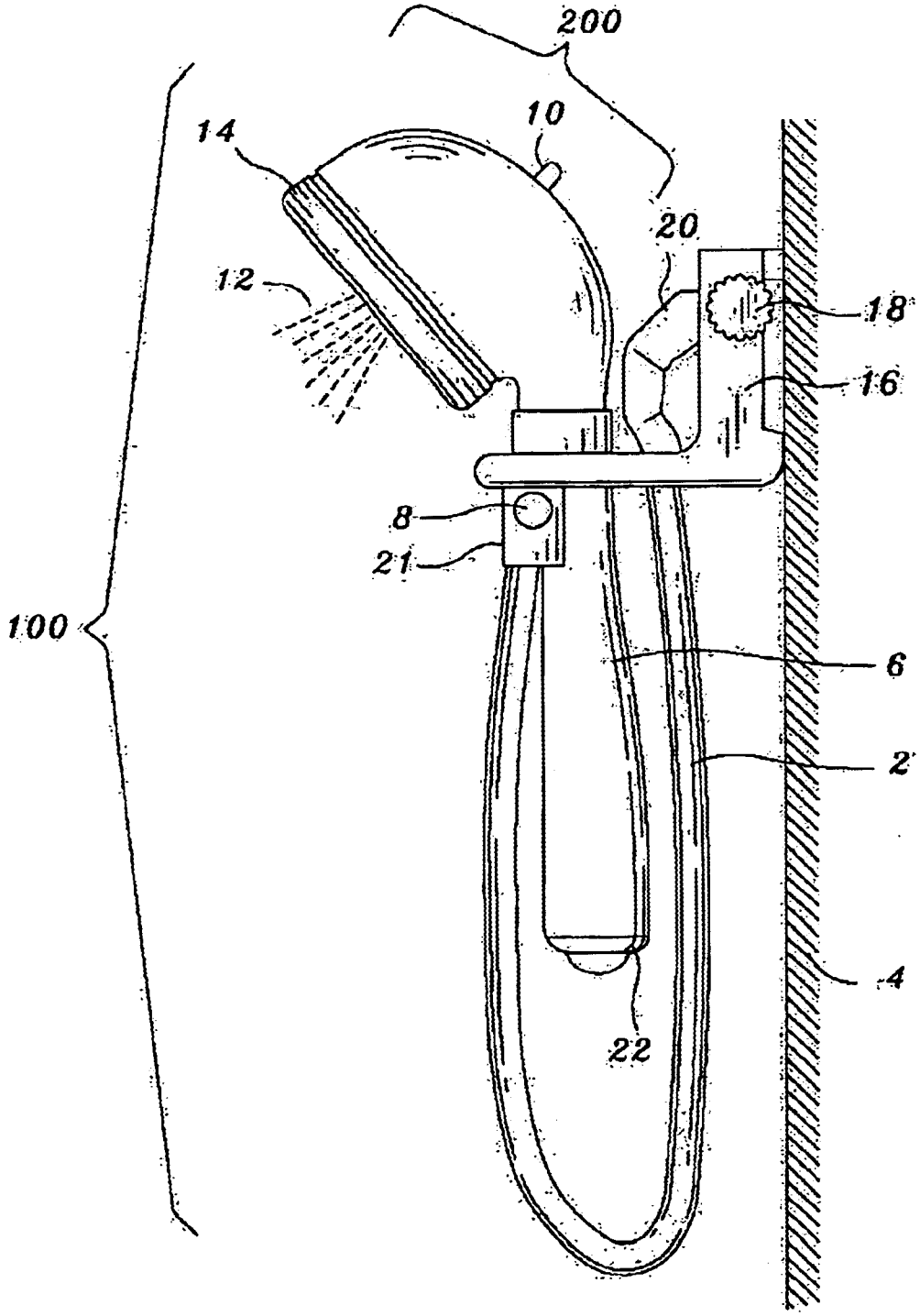
FIG. 1 is a side view of the invention.
Figure 2:
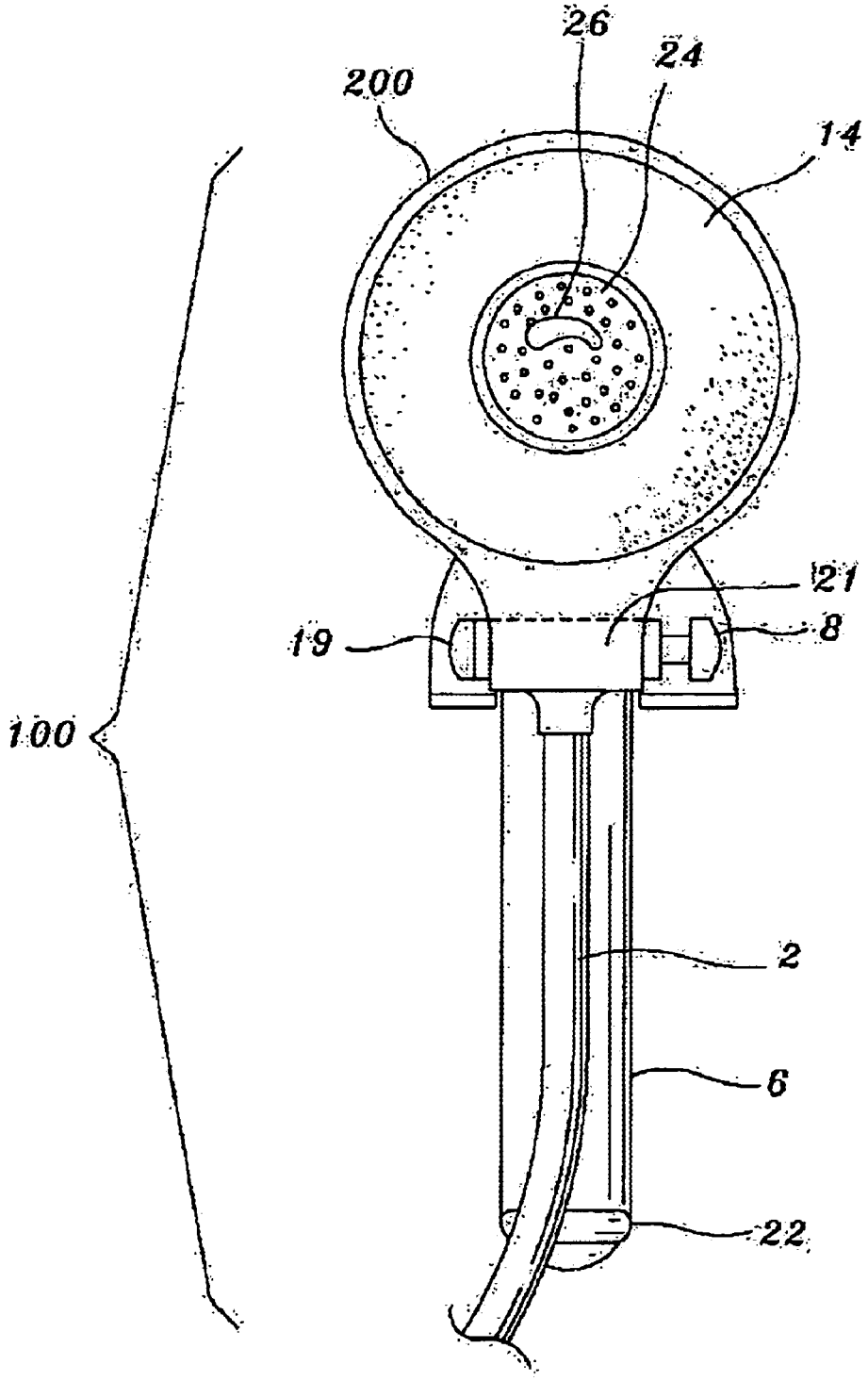
FIG. 2 is a front view of the invention
Figure 3:
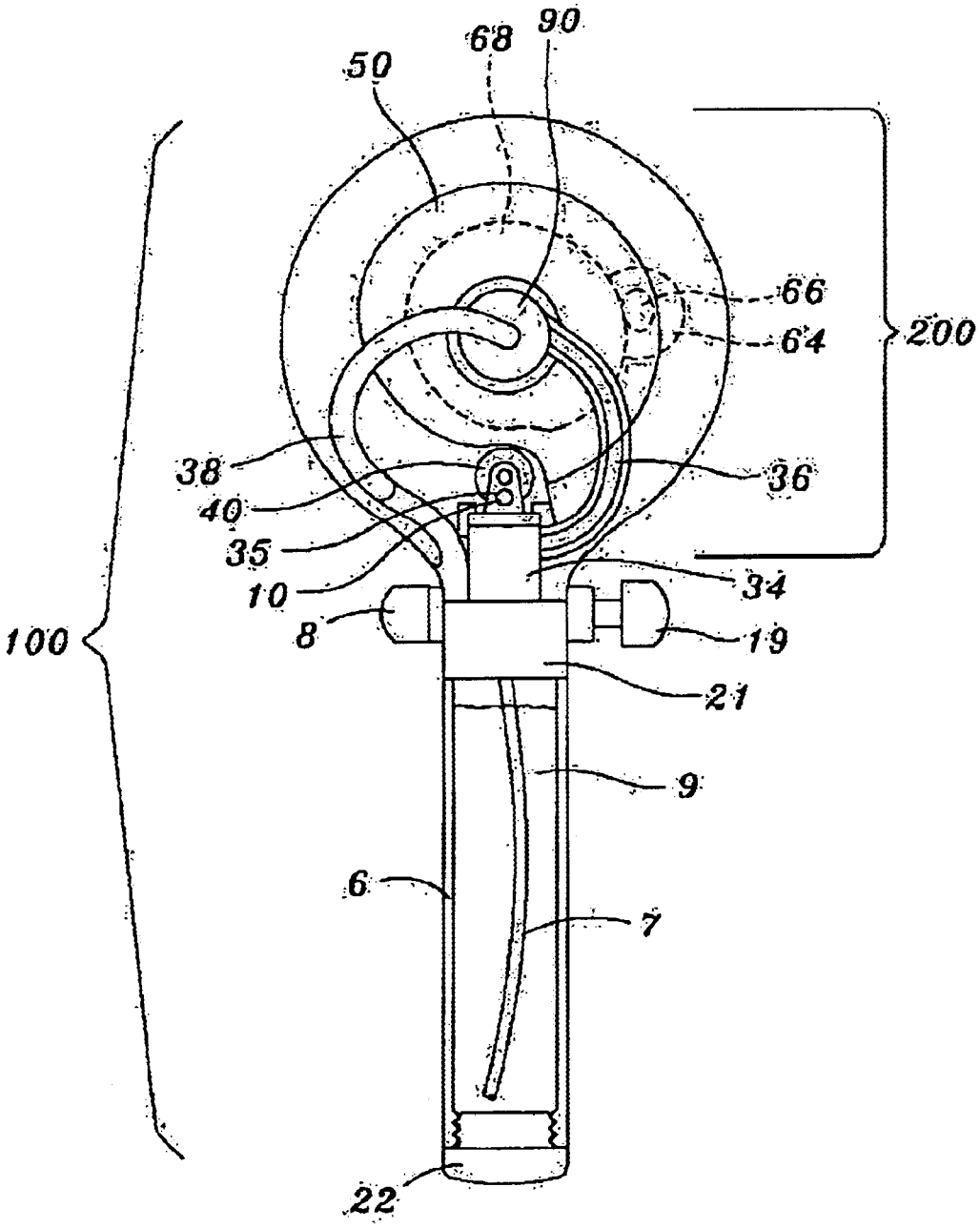
FIG. 3 is a back view the invention with the back cover removed

Referring now to FIG. 1 we see a side view of the present invention 100. The device 100 is held in a vertical position by hanging bracket 16. Hanging bracket 16 is attached to shower spigot 20 via tightening screw 18. A flexible hose 2 is attached at one end to shower spigot 20 and at the other end to shuttle valve 21. Shower head assembly 200 is attached to valve assembly 21. Shower head assembly 200 also terminates at its bottom portion in a soap holding reservoir and handle 6. Soap may be added to reservoir 6 by means of removable, replaceable cap 22. A rotatable brush head 14 is attached to the front portion of the shower head assembly 200. Shower water 12 can exit from the front of shower head assembly 200 when the user pushes a button 8 on shuttle valve 21. FIG. 2 is a front view of the present invention 100 When the user presses in button 19 of shuttle valve 21, brush head 14 is caused to rotate by means of an internal paddle wheel. Additionally, soap or other moisturizing liquid exits from orifice 26 so that it can be introduced to brush head 14 which then communicates with the user's body. FIG. 3 shows a rear view of the present invention 100. In this view, shower head cover 30 is removed to reveal cam 50 is driven by speed reduction gears 64, 66. The cam 50 causes roller bearing 40 and attached clevis 35 to push on pump head 34 thereby causing liquid 9 contained in the handle portion 6 to be drawn up tube 7 and out through tube 36 and down through central tube 90 and exiting through orifice 26 located within shower head 24 as will be shown in FIG. 4. When push button 8 is pushed in, shuttle valve 21 diverts water to tube 38 that leads to shower head 24 shown in FIG. 4. When the user presses button 19, water is diverted through tube 40 cause water to impinge onto paddle wheel

Figure 4:
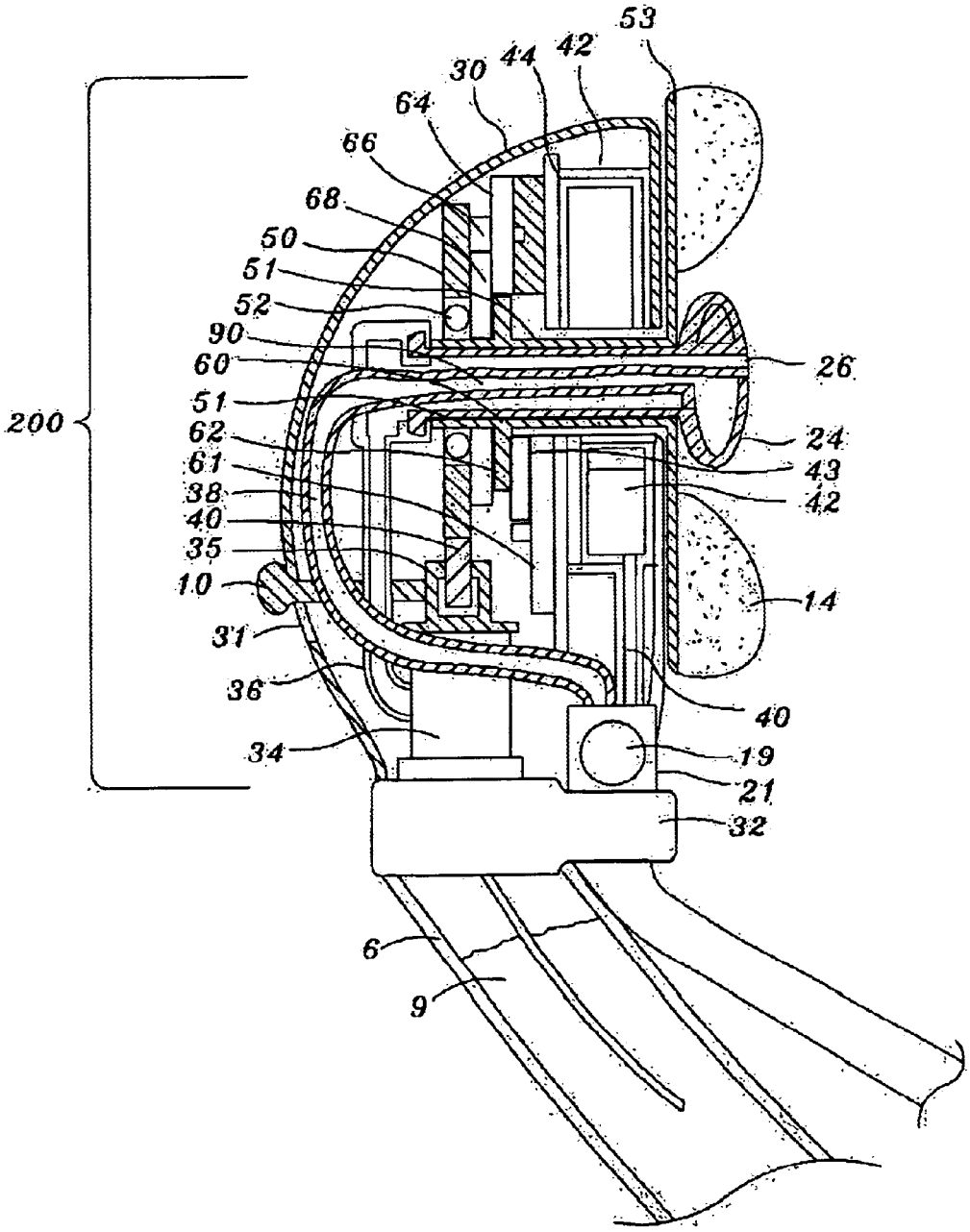
FIG. 4 is a side section view of the invention

42 causing it to spin. Gear 43 is attached to paddle wheel 42 and transfers rotational motion to gears 61 and 62 that then drives gear 60 which is integral with brush tube 51 and attached brush plate 53. Brush head 14 is shown here as a mildly abrasive resilient open celled foam but can also be soft bristles that can gently massage and scrub the user's skin during use. FIG. 4 also shows roller bearing 40 and clevis 35 and its relationship to cam 50. If the user decides to retain the brush head spinning motion but to discontinue the dispensing of soap or other liquid coming from handle area 6, he or she can pull up on knob 10 that causes roller bearing 40 and clevis 35 to become offset from cam 50 so that cam 50 is not driven thereby discontinuing the pumping of liquid 9 from reservoir 6.

In the above described and illustrated way, the present invention allows a user to have the choice of having a normal shower, or using the unique shower head assembly of the present invention, to automatically and simultaneously rotationally scrub and apply liquid soap to his or her body.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Soap Dispensing Shower Head and Brush Head comprising:

a flexible hose and attachment means to fasten to a standard water supply and shower spigot;

a hanging bracket secured to said shower spigot that releasably secures said shower head;

an enclosed chamber that contains a paddle wheel;

said paddle wheel driving a first set of gears that cause a scrub brush to rotate;

a second set of gears powered by said paddle wheel that cause a cam to rotate;

said cam pushing against a soap delivery pump causing said soap to be pushed through an aperture that runs through the center of said shower head assembly;

a selector valve that allows the user to choose between the shower function and the rotating brush, soap delivery function;

an additional mechanical selector switch that allows the user to turn the soap delivery function on or off; and a soap containing reservoir connected to said enclosure that also acts as a handle portion.

2. Soap Dispensing Shower Head and Brush Head as claimed in claim 1 wherein said soap delivery pump creates foaming soap or other foaming skin conditioning liquid.

* * * * *